US011341816B2

(12) United States Patent
Penacho et al.

(10) Patent No.: US 11,341,816 B2
(45) **Date of Patent: *May 24, 2022**

(54) ELECTRONIC GAMING SYSTEM WITH DYNAMIC RETURN TO PLAYER AND METHOD OF USE

(71) Applicant: ARISTOCRAT TECHNOLOGIES AUSTRALIA PTY LIMITED, North Ryde (AU)

(72) Inventors: Gary Joseph Penacho, Henerson, NV (US); Kieran Power, North Ryde (AU)

(73) Assignee: Aristocrat Technologies Australia Pty Limited, North Ryde (AU)

( * ) Notice: Subject to any disclaimer, the term of this patent is extended or adjusted under 35 U.S.C. 154(b) by 0 days.

This patent is subject to a terminal disclaimer.

(21) Appl. No.: 17/102,165

(22) Filed: Nov. 23, 2020

(65) Prior Publication Data

US 2021/0074123 A1 Mar. 11, 2021

Related U.S. Application Data

(63) Continuation of application No. 16/250,110, filed on Jan. 17, 2019, now Pat. No. 10,878,658, which is a continuation of application No. 15/275,409, filed on Sep. 25, 2016, now Pat. No. 10,210,706.

(51) Int. Cl.
*G07F 17/32* (2006.01)

(52) U.S. Cl.
CPC ..... *G07F 17/3244* (2013.01); *G07F 17/3209* (2013.01); *G07F 17/3211* (2013.01); *G07F 17/3237* (2013.01); *G07F 17/3267* (2013.01)

(58) Field of Classification Search
USPC ..... 463/25
See application file for complete search history.

(56) References Cited

U.S. PATENT DOCUMENTS

| | | | |
|---|---|---|---|
| 6,068,552 | A | 5/2000 | Walker |
| 6,520,856 | B1 | 2/2003 | Walker |
| 8,328,628 | B2 | 12/2012 | Kim |
| 8,398,475 | B2 | 3/2013 | De Waal |
| 8,512,132 | B2 | 8/2013 | Nicely |
| 9,147,306 | B2 | 9/2015 | Nicely |

(Continued)

OTHER PUBLICATIONS

Office Action dated May 5, 2020 for U.S. Appl. No. 16/250,110 (pp. 1-6).

(Continued)

*Primary Examiner* — Pierre E Elisca
(74) *Attorney, Agent, or Firm* — Armstrong Teasdale LLP

(57) ABSTRACT

An electronic gaming machine for conducting an electronic game includes a player input interface configured to receive player credit inputs. A gaming data recording device is configured to record gaming related to the player credit inputs. A gaming machine controller configured to query the gaming data recording device and compute a first total game payout rate based upon the recorded player credit inputs for a first number of rounds of play and compute a second total game payout rate different than the first total game payout rate based on the recorded player credit inputs for a second number of rounds of play. The gaming machine is configured to award the second total game payout rate for a next round of play of the electronic game.

20 Claims, 4 Drawing Sheets

(56) References Cited

U.S. PATENT DOCUMENTS

| | | | | |
|---|---|---|---|---|
| 9,257,008 | B2 | 2/2016 | Plowman | |
| 9,305,419 | B2 | 4/2016 | Kim | |
| 9,773,375 | B2 * | 9/2017 | Baerlocher | G07F 17/3244 |
| 2002/0039923 | A1 * | 4/2002 | Cannon | G07F 17/3211 463/42 |
| 2004/0248642 | A1 | 12/2004 | Rothschild | |
| 2006/0247033 | A1 * | 11/2006 | Walker | G07F 17/3244 463/25 |
| 2007/0060382 | A1 * | 3/2007 | Ando | G07F 17/3237 463/43 |
| 2009/0239622 | A1 * | 9/2009 | Fujimori | G07F 17/3244 463/20 |
| 2009/0298573 | A1 | 12/2009 | Bramble | |
| 2014/0094293 | A1 | 4/2014 | Nicely | |
| 2014/0235329 | A1 * | 8/2014 | Saruta | G07F 17/32 463/25 |
| 2015/0018087 | A1 | 1/2015 | Nicely | |
| 2015/0087376 | A1 | 3/2015 | Hutchinson-Kay | |
| 2015/0379822 | A1 | 12/2015 | Ellis | |
| 2016/0011094 | A1 | 1/2016 | Kennington | |
| 2016/0086443 | A1 * | 3/2016 | Baerlocher | G07F 17/3244 463/13 |
| 2016/0110943 | A1 | 4/2016 | Nicely | |
| 2016/0117887 | A1 * | 4/2016 | Berman | G07F 17/3267 463/16 |

OTHER PUBLICATIONS

Notice of Allowance dated Aug. 24, 2020 for U.S. Appl. No. 16/250,110 (pp. 1-9).

* cited by examiner

ELECTRONIC GAMING SYSTEM WITH DYNAMIC RETURN TO PLAYER AND METHOD OF USE

CROSS-REFERENCE TO RELATED APPLICATIONS

This application is a continuation of U.S. patent application Ser. No. 16/250,110, filed Jan. 17, 2019 which is a continuation of U.S. patent application Ser. No. 15/275,409 filed Sep. 25, 2016, the entire contents and disclosures of which are hereby incorporated herein by reference in their entireties.

BACKGROUND

The embodiments described herein relate generally to electronic gaming systems and methods that provide electronic games with dynamic return to player (RTP) and, more particularly, to an electronic gaming system that provides various levels of RTP based on play history.

Generally, many known electronic gaming machines are configured to provide a certain predetermined RTP when measured over many rounds of play of a given electronic game. RTP is defined as a percentage of an amount wagered over the course of a large sample of rounds of play. For example, an RTP of 15% of credits wagered in a particular electronic game may indicate that over the course of 1000 rounds of play of that particular game, the electronic game will award 15% of all credits wagered in those 1000 rounds of play back to the one or more players who played those 1000 rounds of play. The precise RTP percentage and number of rounds of play that constitute a large sample varies from game-to-game, and casino-to-casino. A particular RTP for an electronic game may not hold true for a small number of rounds of play of the electronic game. For example, a player wagering 100 credits over the course of 10 rounds of play of a particular electronic game having a 15% RTP will not necessarily be awarded 15 credits over those 10 rounds of play. The actual RTP may vary greatly from the set RTP over a mere 10 rounds of play.

RTP is generally a composite property of a particular electronic game, combining the effects of payouts in a base game, payouts in a feature game, and frequency at which bonus games are awarded. Conventionally, many electronic gaming machines are configured by a gaming establishment, or casino, to have a certain RTP. Such configurations produce consistent RTP over the course of many players, many rounds of play, and all levels of wagering.

BRIEF DESCRIPTION

In one aspect, an electronic gaming machine is provided, including a memory and a game controller. The memory is for storing a first return-to-player (RTP) rate as a current RTP rate and a second RTP rate as an inactive RTP rate. The game controller is configured to gain access to the gaming data. The game controller is further configured to configure conduct the electronic game at the first RTP rate. The game controller is also configured to reconfigure the current RTP rate to be the second RTP rate based on a scheduled timing. The game controller is further configured to conduct the electronic game at the second RTP rate during the scheduled timing.

In another aspect, an electronic gaming system is provided, including a memory and a game controller. The memory stores a plurality of tiers of wager amounts. Each tier of the plurality of tiers of wager amounts includes at least one threshold that defines a range of wager amount associated with the tier and a return-to-player (RTP) rate associated with that tier. The memory also stores a current RTP rate of the electronic game. The game controller is configured to receive a current wager amount for a current round of play of the electronic game. The game controller is also configured to determine a first tier from the plurality of tiers of wager amounts based on the current wager amount. The game controller is further configured to reconfigure the current RTP rate for the current round of play to be the RTP rate associated with the determined first tier. The game controller is also configured to conduct the current round of play at the reconfigured RTP rate.

In yet another aspect, an electronic gaming system is provided, including a memory and a game controller. The memory stores a first return-to-player (RTP) rate associated with a base game of the electronic game and a second RTP rate associated with a feature game. The feature game is activated during the base game. The game controller is configured to conduct the base game at the first RTP rate. The game controller is also configured to activate a feature game based on an outcome of the base game. The game controller is further configured to conduct the feature game at the second RTP rate.

BRIEF DESCRIPTION OF THE DRAWINGS

The embodiments described herein may be better understood by referring to the following description in conjunction with the accompanying drawings.

DETAILED DESCRIPTION

Figure 1:
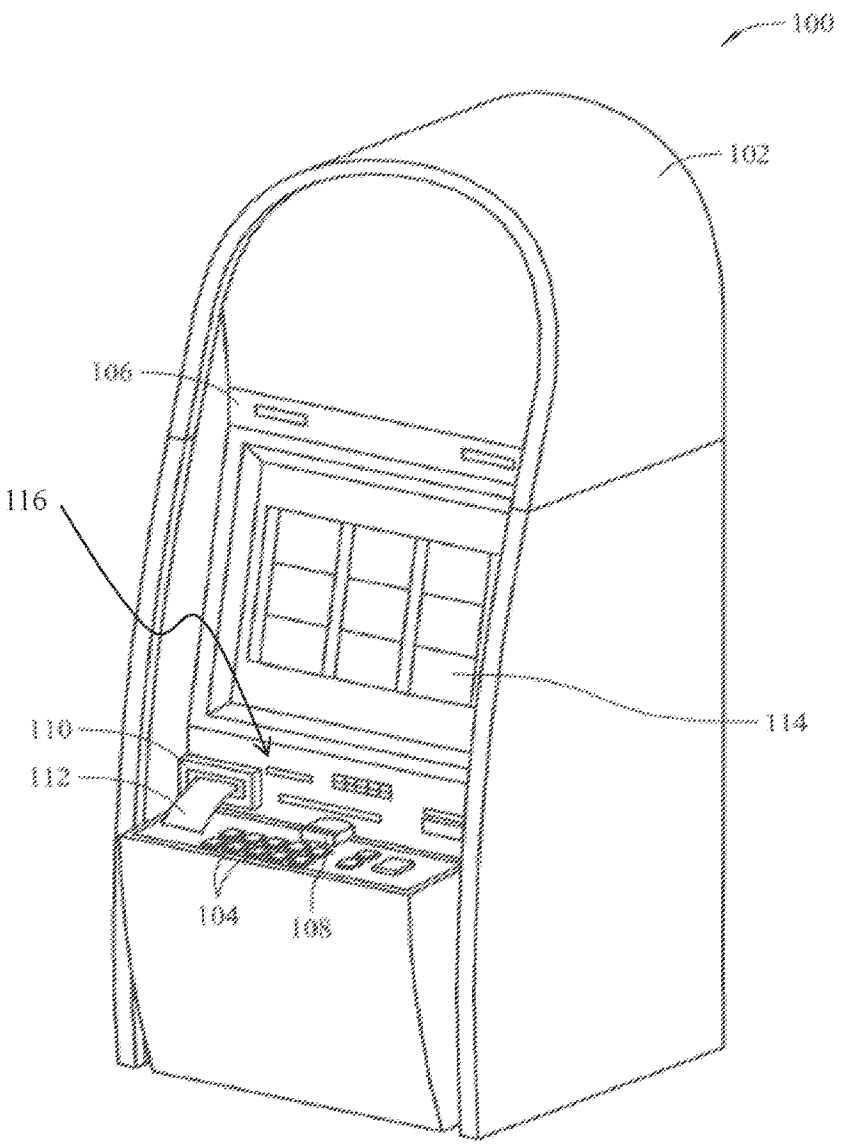
FIG. 1 is a schematic diagram of an exemplary electronic gaming machine.

Many gaming establishments utilize a casino management system to collect various aspects of electronic gaming data, including, for example, amounts wagered for each round of play at each electronic gaming machine. Certain casino management systems are typically connected to various electronic gaming machines within the casino over a local communication network, such as, for example, a local area network (LAN). Certain casino management systems may be used to configure the various electronic gaming machines within the casino. Such configuring may be based on the various collected gaming data. Configuring a given electronic gaming machine may include various aspects of the electronic game itself, including the game itself, pay tables, feature games, jackpots, progressive jackpots, promotions, tournaments, group play, and RTP, for example.

Certain configuration activities are carried out while the electronic gaming machine is inoperable. For example, transitioning from a first electronic game to a second electronic game is largely carried out after the first electronic game has terminated and before the second electronic game is initiated. Other configuration activities may be carried out dynamically. For example, jackpots and progressive jackpots are updated regularly or, in some embodiments, continuously. It is realized herein that RTP for an electronic gaming machine may be configured dynamically. Configuring RTP may be carried out by a controller in the electronic gaming machine itself, or remotely by a server, such as a game server, a configuration terminal, or a casino management system, for example. Dynamic configuration of RTP facilitates tailoring RTP for certain players, for an event, or according to a schedule without disabling the electronic gaming machine. Such configuration of RTP reduces downtime and improves player engagement.

It is further realized herein that RTP for an electronic gaming machine may be configured based on various gaming data collected from the electronic gaming machine. Such gaming data may include, for example, wagers, game outcomes, payouts, player ratings, duration of play, and time between rounds of play. In certain embodiments, RTP is configured based on recent wagering history, for example, such that RTP is configured at a certain RTP level according to a moving average of a previous number, N, of wagers.

For some electronic gaming machines, RTP is configured based on defined wagering thresholds. For example, an electronic gaming machine may configure RTP at 10% for a current wager below 10 credits, at 15% for a current wager between 10 and 20 credits, and at 20% for a current wager above 20 credits. Such RTP configurations reward players for risking a larger wager on the electronic game. It is realized herein that an RTP configured according to the current wager may vary from an RTP configured according to recent wagering history. In certain embodiments, under these circumstances, the RTP may be configured as the greater RTP of the RTP based on the current wager and the RTP based on the wagering history.

Many electronic gaming machines, under certain circumstances, award players with RTP enhancements during the course of one or more round of play of an electronic game. For example, a player may be awarded a 1% RTP boost upon a particular game outcome in a base game or a feature game. In certain embodiments, such RTP enhancements accumulate in addition to RTP configurations based on gaming data.

It is realized herein that RTP configurations may be implemented in various ways, including, for example, modifying the RTP in a base game, modifying the RTP in a feature game, modifying the frequency of awarding a feature game, or some combination of two or more modifications.

It is further realized herein that wagering histories and RTP configurations may be cleared occasionally or periodically. For example, an electronic gaming machine may clear a wagering history, for the purpose of configuring RTP, after a defined duration of inactivity, or after a defined duration of inactivity with a zero credit balance. Likewise, the wagering history may be cleared after a cash-out operation is carried out.

Exemplary technical effects of the systems, methods, and apparatus described herein include at least one of: (a) dynamically configuring RTP for an electronic gaming machine; (b) correlating RTP for an electronic gaming machine to a current wager and a history of wagers; (c) configuring RTP for an electronic gaming machine without disabling or removing the electronic gaming machine from service; (d) reducing downtime for electronic gaming machines; (e) reducing network bandwidth demand for configuring various electronic gaming machines by utilizing local RTP configuration; (f) correlating RTP for an electronic gaming machine to gaming data for that electronic gaming machine; and (g) efficiently allocating RTP for a casino among a plurality of electronic gaming machines.

FIG. 1 is a schematic diagram of an exemplary gaming machine 100. Gaming machine 100 may be any type of gaming machine, and may include, without limitation, different structures than those shown in FIG. 1, such as, for example, a personal computer, tablet computer, smart phone, personal digital assistant (PDA), cellular phone, and any other network-enabled device. Moreover, gaming machine 100 may employ different methods of operation than those described below. Gaming machine 100 may be configured as a Class II gaming machine or as a Class III gaming machine.

In the exemplary embodiment, gaming machine 100 includes a cabinet 102 that houses a plurality of components, such as a gaming machine controller, peripheral devices, displays, and/or player interaction devices. For example, in an exemplary embodiment, gaming machine 100 includes a plurality of user interfaces, or input devices, such as switches and/or buttons 104 that are coupled to a front 106 of cabinet 102. Buttons 104 may be used to start play of a primary or secondary game. One button 104 may be a "Bet One" button that enables the player to place a bet or to increase a bet. Another button 104 may be a "Bet Max" button that enables the player to bet a maximum permitted wager. Yet another button 104 may be a "Cash Out" button that enables the player to receive a cash payment or other suitable form of payment, such as a ticket or voucher that corresponds to a number of remaining credits. User interfaces, in certain embodiments, include one or more touch screens as user interfaces.

In the exemplary embodiment, gaming machine 100 also includes a credit input device 116. Credit input device 116 may include a coin acceptor 108 for accepting coins and/or tokens, a bill acceptor 110 for accepting and/or validating cash bills, coupons, and/or ticket vouchers 112. Bill acceptor 110 may also be capable of printing tickets 112. Furthermore, in some embodiments, credit input device 116 includes a card reader or a validator for use with credit cards, debit cards, identification cards, and/or smart cards. Cards accepted by the card reader or validator may include a magnetic strip and/or a preprogrammed microchip that includes a player's identification, credit totals, and any other relevant information that may be used. In certain embodiments, credit input device 116 may include a credit input module that interfaces with a server to accept credit and wagers.

Moreover, in the exemplary embodiment, gaming machine 100 includes one or more displays 114. Displays 114 are mounted to cabinet 102, and may include a primary display for displaying a primary game and a secondary display for displaying a secondary or bonus game. Displays 114 may be further configured to display credit balances, wager amounts, cumulative wagering information, payout amounts, and RTP information. Displays 114 may include, without limitation, a plasma display, a liquid crystal display (LCD), a display based on light emitting diodes (LEDs), organic light emitting diodes (OLEDs), polymer light emitting diodes (PLEDs), and/or surface-conduction electron emitters (SEDs), a speaker, an alarm, and/or any other device capable of presenting information to a user.

Figure 2:
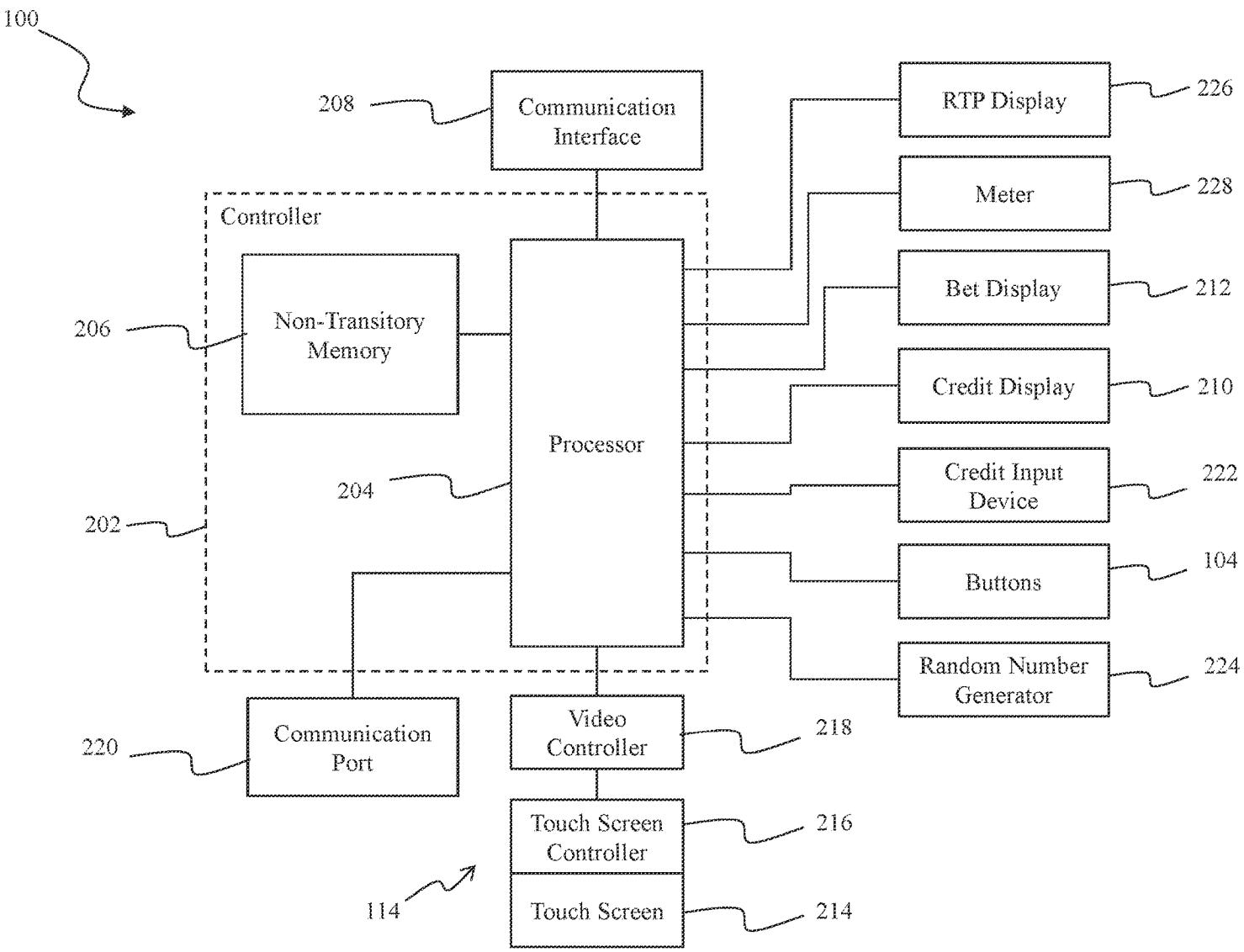
FIG. 2 is an exemplary block circuit diagram that may be used with the gaming machine shown in FIG. 1.

FIG. 2 is a schematic block diagram of gaming machine 100. In the exemplary embodiment, gaming machine 100 includes a gaming machine controller 202 having a processor 204 communicatively coupled to a non-transitory memory 206. Moreover, in the exemplary embodiment, processor 204 and non-transitory memory 206 reside within cabinet 102 (shown in FIG. 1) and may be collectively referred to herein as a "computer" or "controller." Gaming machine 100 is configurable and/or programmable to perform one or more operations described herein by programming processor 204. For example, processor 204 may be programmed by encoding an operation as one or more executable instructions and providing the executable instructions in non-transitory memory 206.

Controller 202 communicates with one or more other gaming machines 100 or other suitable devices via a communication interface 208. Communication interface 208 may operate as an input device (e.g., by receiving data from another device) and/or as an output device (e.g., by transmitting data to another device). Processor 204 may be a microprocessor, a microcontroller-based platform, a suitable integrated circuit, and/or one or more application-specific integrated circuits (ASICs). However, the above examples are exemplary only, and thus are not intended to limit in any way the definition and/or meaning of the term "processor." Gaming machine 100 includes a random number generator 224. In certain embodiments, random number generator 224 is integrated into controller 202 or processor 204. Random number generator 224 is configured to be secure from unauthorized access, manipulation, or compromise. Generally, an output of random number generator 224 is the basis on which game outcomes are determined by controller 202.

In certain embodiments, data and the computer-executable instructions may be stored in a cloud service, a database, or other non-transitory memory accessible by gaming machine 100. Such embodiments reduce the computational and storage burden on gaming machine 100. As such, non-transitory memory 206 may be a local and/or a remote computer storage media including memory storage devices. Moreover, non-transitory memory 206 may include one or more forms of memory. For example, non-transitory memory 206 can include random access memory (RAM), read-only memory (ROM), flash memory, and/or electrically erasable programmable read-only memory (EEPROM). In some embodiments, other suitable magnetic, optical, and/or semiconductor-based memory may be included in non-transitory memory 206 by itself or in combination.

When games are implemented in an online environment, at least a portion of the game software is stored in a remote game server, or in a cloud computing service. Game transactions such as adding money to the game, i.e., cash in, and withdrawing money from the game, i.e., cash out, are substituted by implementing electronic fund transfers. Each player deposits money into his online gaming account via checks, debit cards, wire and the like. Once funded, the player can move a portion of the cash in his account into the game he wants to play. This process is referred to as account-based wagering. Account-based wagering is a convenient monetary transaction system for online and mobile wagering environments since the physical bill acceptor and ticket printer are not available. In addition to the accounting meters' separation requirement, the detection of the location where the wagering transaction take place is also required in order to enforce local gaming regulations and to properly calculate revenue, profit, and tax withholdings, for example.

Non-transitory memory 206, in certain embodiments, is a physical storage device, such as, for example, a cartridge that is removable from gaming machine 100. Further, in certain embodiments, non-transitory memory 206 includes multiple removable physical storage devices, each configured to store certain executable program modules. In alternative embodiments, non-transitory memory 206 includes multiple partitions of a single physical storage device, each partition configured to store certain executable program modules.

Gaming machine 100 includes a credit input device 222 for accepting various forms of money or credit. Credit input device 222 may include one or more of a coin acceptor, bill validator, ticket reader, or card reader, for example. In certain embodiments, credit input device 222 includes an interface to a server configured to accept credits to establish a credit balance at gaming machine 100. Gaming machine 100 further includes at least one meter 228 for tracking and recording gaming data, including, for example amounts wagered on gaming machine 100.

Gaming machine 100 includes a credit display 210 that displays a player's current number of credits, cash, account balance or the equivalent. Gaming machine 100 also includes a bet display 212 that displays a player's amount wagered. Credit display 210 and bet display 212 may be standalone displays independent of display 114, or credit display 210 and bet display 212 may be incorporated into display 114. Gaming machine 100 includes an RTP display 226 that indicates a current RTP rate at which gaming machine 100 is configured.

Moreover, in an exemplary embodiment, display 114 is controlled by controller 202. In some embodiments, display 114 includes a touch screen 214 and an associated touch screen controller 216. In such embodiments, display 114 may operate as an input device in addition to presenting information. A video controller 218 is communicatively coupled to controller 202 and touch screen controller 216 to enable a player to input game play decisions (e.g., actions on and selections of game presentation objects) into gaming machine 100 via touch screen 214. Furthermore, gaming machine 100 includes one or more communication ports 220 that enable controller 202 to communicate with external peripheral devices (not shown) such as, but not limited to, external video sources, expansion buses, other displays, a SCSI port, or a key pad.

Controller 202 conducts the electronic game and generates gaming data. Gaming data may include, for example, wagers, game outcomes, payouts, player ratings, duration of play, and time between rounds of play. For each round of play of the electronic game, controller 202 conducts the electronic game and awards a payout according to a current RTP rate set for electronic gaming machine 100. Controller 202 may compute a new RTP for a next round of play of the electronic game based on the gaming data. For example, in certain embodiments, controller 202 may compute a moving average of a certain quantity of most-recent wagers. Controller 202 may then compute a new RTP rate based on the moving average. For example, controller 202 may compute a moving average wager for the previous 10 rounds of play. As the moving average increases, the computed RTP rate moves proportionally and with the moving average (i.e., increasing). Likewise, as the moving average decreases, the computed RTP rate moves proportionally and with the moving average (i.e., decreasing).

Figure 3:
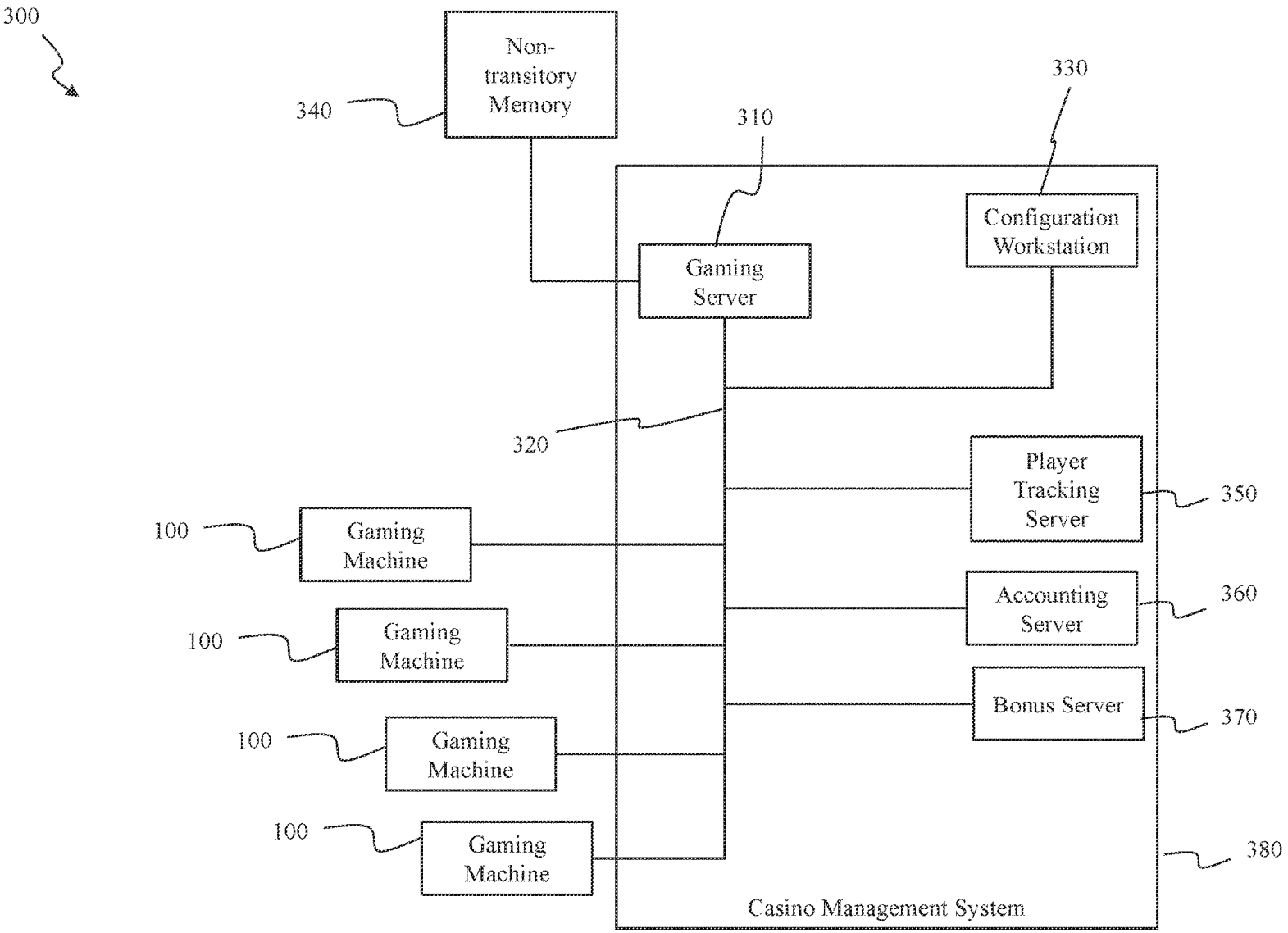
FIG. 3 is a block schematic diagram of an exemplary electronic gaming system that includes a plurality of electronic gaming machines such as the gaming machine shown in FIG. 1.

FIG. 3 is a block schematic diagram of an exemplary electronic gaming system 300 that includes a plurality of electronic gaming machines 100 (shown in FIG. 1). Each gaming machine 100 is coupled via communication interface 208 (shown in FIG. 2) to one or more servers, such as a gaming server 310, using a network 320. In certain embodiments, gaming system 300 may include a player tracking server 350, an accounting server 360, and a bonus server 370. Gaming server 310, player tracking server 350, accounting server 360 and bonus server 370 combine to form a casino management system 380. Gaming server 310 may have an electrical architecture similar to that of gaming machine 100. Gaming server 310 includes a processor (not shown) and a network interface, such as communication port 220 that facilitates data communication between gaming server 310, each gaming machine 100, and other components of gaming system 300. Such data is stored in, for example, a non-transitory memory 340, such as a database, that is coupled to gaming server 310.

Casino management system 380 includes a configuration workstation 330 coupled to server 310 and gaming machines 100 through network 320. In one embodiment, one or more gaming machines 100 may be remote gaming machines that access a casino via network 320. As such, a player is able to participate in a game of chance on a remote gaming machine. In such an embodiment, it will be understood that a player operating a remote gaming machine has virtual access to any casino coupled to network 320 and associated with gaming server 310. Gaming machines 100 may also be a personal computers coupled to the Internet via a virtual private network such that a player may participate in a game of chance, remotely. In other embodiments, the player may use a cell phone or other mobile devices (e.g., tablets, PDAs, laptops, and the like) coupled to a wired or wireless communication network to establish a connection with a particular casino. Moreover, gaming machines 100 may be terminal-based machines, wherein the actual games, including random number generation and/or outcome determination, are performed at gaming server 310. In such an embodiment, gaming machines 100 display results of a game via display 114 (shown in FIGS. 1 and 2).

In one embodiment, gaming server 310 performs a plurality of functions including, game outcome generation, player tracking functions, and/or accounting functions, to name a few. For example, gaming server 310 may track data of players using gaming machines 100. For example, gaming server 310 can store physical characteristics of players, such as, but not limited to, a gender of a player and an age of a player. Gaming server 310 can also track and store other data related to the players using player tracking identification, such as a player card. For example, gaming server 310 can store information about a player, such as loyalty points, player address, phone number, and/or any information that may be retrieved and transmitted to gaming machines 100. In some embodiments, gaming server 310 stores and tracks information such as, but not limited to, an average amount of a wager played at gaming machines 100, any funds a player may have in an account, as well as data relating to reportable events. However, in alternative embodiments, gaming system 300 may include a plurality of servers that separately perform these functions and/or any suitable function for use in a network-based gaming system.

Casino management system 380 includes at least one processor among gaming server 310, configuration workstation 330, player tracking server 350, accounting server 360, and bonus server 370. Casino management system 380 is coupled to gaming machines 100 over network 320. Casino management system 380 is configured to receive gaming data from gaming machines 100 as each of gaming machines 100 conducts various rounds of play of one or more electronic games.

An electronic game is carried out on at least one gaming machine 100, for example, by controller 202 (shown in FIG. 2). Controller 202 conducts the electronic game and generates gaming data. Gaming data may include, for example, wagers, game outcomes, payouts, player ratings, duration of play, and time between rounds of play. For each round of play of the electronic game, controller 202 conducts the electronic game and awards a payout according to a current RTP rate set for electronic gaming machine 100.

Casino management system 380 may compute a new RTP for a next round of play of the electronic game based on the gaming data received from gaming machine 100. For example, in certain embodiments, casino management system 380 may compute a moving average of a certain quantity of most-recent wagers on gaming machine 100. Casino management system 380 may then compute a new RTP rate based on the moving average. For example, casino management system 380 may compute a moving average wager for the previous 10 rounds of play. As the moving average increases, the computed RTP rate moves proportionally and with the moving average (i.e., increasing). Likewise, as the moving average decreases, the computed RTP rate moves proportionally and with the moving average (i.e., decreasing). Casino management system 380 then configures gaming machine 100 to operate with the newly computed RTP rate.

Figure 4:
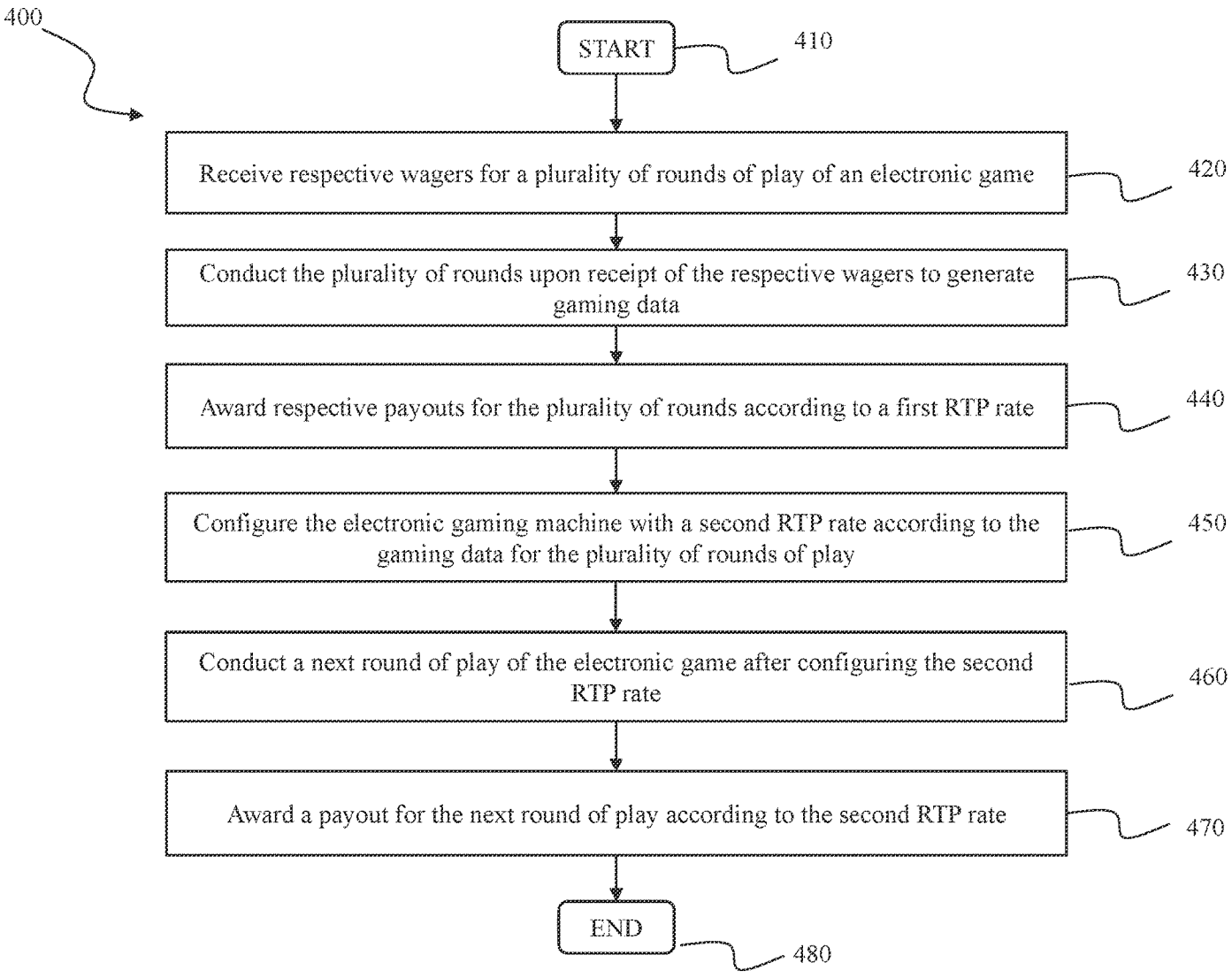
FIG. 4 is a flow diagram of an exemplary method of configuring an electronic gaming machine.

FIG. 4 is a flow diagram of an exemplary method 400 of configuring an electronic gaming machine, such as electronic gaming machine 100 (shown in FIGS. 1-3). Method 400 begins at a start step 410. At a wagering step 420, respective wagers are received for a plurality of rounds of play of an electronic game. The plurality of rounds of play is conducted at a conducting step 430. Each round of play is conducted upon receipt of its respective wager. Gaming machine 100 generates gaming data as each round of play of the electronic game is conducted. Further, at an awarding step 440, respective payouts for the plurality of rounds of play are awarded according to a first RTP rate.

At a configuration step 450, electronic gaming machine 100 is configured with a second RTP rate. The second RTP rate is computed based on gaming data generated while conducting the plurality of rounds of play of the electronic game. In certain embodiments, the second RTP rate is computed based on a history of wagers on electronic gaming machine 100. The history of wagers may include, for example, a moving average of a quantity of most-recent wagers. For example, the second RTP rate may be computed based on a moving average of the last 10 wagers. In certain embodiments, the wager history may be reset under various conditions. Such conditions may include, for example, electronic gaming machine 100 being inactive for a duration of time, or a credit balance of zero while electronic gaming machine 100 is inactive for a duration of time.

In certain embodiments, the second RTP rate is selected from a set of discrete RTP rates corresponding to various gaming data thresholds. For example, wagering thresholds may be set at 5, 10, 15, and 20 credits, such that a moving average below 5 credits calls for an RTP rate A, a moving average from 5 to 10 credits calls for an RTP rate B, a moving average from 10-15 credits calls for an RTP rate C, a moving average from 15-20 credits calls for an RTP rate D, and a moving average of 20 credits or more calls for an RTP rate E. In alternative embodiments, the second RTP rate may be computed as a continuous function of gaming data. For example, the computed RTP rate varies continuously with the moving average from 0 to 20 credits, where the maximum RTP rate is achieved at a moving average of 20 credits or more. In certain embodiments, the second RTP rate varies with the gaming data; while in other embodiments, the second RTP rate varies inversely with the gaming data.

In certain embodiments, multiple potential RTP rates may be computed. For example, a current wager exceeding a threshold may call for one RTP rate, while a moving average exceeding another threshold may call for another RTP rate. In such embodiments, gaming machine 100 is configured with one of the potential RTP rates. For example, gaming machine 100 may be configured with the RTP rate having a larger value.

In certain embodiments, configuration step 450 may include adjusting a base game RTP components, adjusting a bonus game RTP component, and adjusting a frequency at which the bonus game is awarded. Each such adjustment modifies the probabilities governing the overall RTP rate at which the next round of play is conducted.

At a conducting step 460, a next round of play of the electronic game is conducted on gaming machine 100. The next round of play is conducted after the second RTP rate is configured on gaming machine 100. A payout determined according to the second RTP rate is awarded, at an awarding step 470, as a result of conducting the next round of play. The method terminates at an end step 480.

Further, the systems and methods described herein are not limited to the specific embodiments described herein but, rather, operations of the methods and/or components of the system and/or apparatus may be utilized independently and separately from other operations and/or components described herein. Further, the described operations and/or components may also be defined in, or used in combination with, other systems, methods, and/or apparatus, and are not limited to practice with only the systems, methods, and storage media as described herein.

A computer, controller, or server, such as those described herein, includes at least one processor or processing unit and a system memory. The computer, controller, or server typically has at least some form of computer readable non-transitory media. As used herein, the terms "processor" and "computer" and related terms, e.g., "processing device", "computing device", and "controller" are not limited to just those integrated circuits referred to in the art as a computer, but broadly refers to a microcontroller, a microcomputer, a programmable logic controller (PLC), an application specific integrated circuit, and other programmable circuits "configured to" carry out programmable instructions, and these terms are used interchangeably herein. In the embodiments described herein, memory may include, but is not limited to, a computer-readable medium or computer storage media, volatile and nonvolatile media, removable and non-removable media implemented in any method or technology for storage of information such as computer readable instructions, data structures, program modules, or other data. Such memory includes a random access memory (RAM), computer storage media, communication media, and a computer-readable non-volatile medium, such as flash memory. Alternatively, a floppy disk, a compact disc-read only memory (CD-ROM), a magneto-optical disk (MOD), and/or a digital versatile disc (DVD) may also be used. Also, in the embodiments described herein, additional input channels may be, but are not limited to, computer peripherals associated with an operator interface such as a mouse and a keyboard. Alternatively, other computer peripherals may also be used that may include, for example, but not be limited to, a scanner. Furthermore, in the exemplary embodiment, additional output channels may include, but not be limited to, an operator interface monitor.

Further, as used herein, the terms "software" and "firmware" are interchangeable, and include any computer program stored in memory for execution by personal computers, workstations, clients and servers.

As used herein, the term "non-transitory computer-readable media" is intended to be representative of any tangible computer-based device implemented in any method or technology for short-term and long-term storage of information, such as, computer-readable instructions, data structures, program modules and sub-modules, or other data in any device. Therefore, the methods described herein may be encoded as executable instructions embodied in a tangible, non-transitory, computer readable medium, including, without limitation, a storage device and a memory device. Such instructions, when executed by a processor, cause the processor to perform at least a portion of the methods described herein. Moreover, as used herein, the term "non-transitory computer-readable media" includes all tangible, computer-readable media, including, without limitation, non-transitory computer storage devices, including, without limitation, volatile and nonvolatile media, and removable and non-removable media such as a firmware, physical and virtual storage, CD-ROMs, DVDs, and any other digital source such as a network or the Internet, as well as yet to be developed digital means, with the sole exception being a transitory, propagating signal.

Although the present disclosure is described in connection with an exemplary gaming system environment, embodiments of the present disclosure are operational with numerous other general purpose or special purpose gaming system environments or configurations. The gaming system environment is not intended to suggest any limitation as to the scope of use or functionality of any aspect of the disclosure. Moreover, the gaming system environment should not be interpreted as having any dependency or requirement relating to any one or combination of components illustrated in the exemplary operating environment.

Embodiments of the present disclosure may be described in the general context of computer-executable instructions, such as program components or modules, executed by one or more computers or other devices. Aspects of the present disclosure may be implemented with any number and organization of components or modules. For example, aspects of the present disclosure are not limited to the specific computer-executable instructions or the specific components or modules illustrated in the figures and described herein. Alternative embodiments of the present disclosure may include different computer-executable instructions or components having more or less functionality than illustrated and described herein.

The order of execution or performance of the operations in the embodiments of the present disclosure illustrated and described herein is not essential, unless otherwise specified. That is, the operations may be performed in any order, unless otherwise specified, and embodiments of the present disclosure may include additional or fewer operations than those disclosed herein. For example, it is contemplated that executing or performing a particular operation before, contemporaneously with, or after another operation is within the scope of aspects of the present disclosure.

When introducing elements of aspects of the present disclosure or embodiments thereof, the articles "a," "an," "the," and "said" are intended to mean that there are one or more of the elements. The terms "comprising," including," and "having" are intended to be inclusive and mean that there may be additional elements other than the listed elements.

The present disclosure uses examples to disclose the best mode, and also to enable any person skilled in the art to practice the claimed subject matter, including making and using any devices or systems and performing any incorporated methods. The patentable scope of the present disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An electronic gaming machine for conducting an electronic game, the electronic gaming machine comprising:

a player input interface configured to receive player credit inputs;

a gaming data recording device configured to record the player credit inputs for game play on the gaming machine;

a gaming machine controller configured to:

query the gaming data recording device and compute a first total game payout rate based upon the recorded player credit inputs for a first number of rounds of play;

compute a second total game payout rate different than the first total game payout rate based on the recorded player credit inputs for a second number of rounds of play; and configure the gaming machine to award the second total game payout rate for a next round of play of the electronic game.

2. The electronic gaming machine according to claim 1, wherein the gaming machine controller is configured to compute the first total game payout rate based upon a first moving average of the recorded player credit inputs for the first number of rounds of play, and wherein the first total game payout rate is a return-to-player (RTP).

3. The electronic gaming machine according to claim 2, wherein the gaming machine controller is configured to compute the second total game payout rate based upon a second moving average of the recorded player credit inputs for the second number of rounds of play, and wherein the second total game payout rate is a second RTP.

4. The electronic gaming machine according to claim 3, wherein the gaming machine controller is further configured to compare the second moving average to the first moving average, and proportionately increase the second RTP rate based upon the comparison.

5. The electronic gaming machine according to claim 1, wherein the gaming machine controller is further configured to reset the first total game payout rate or the second total game payout rate after a threshold condition has been satisfied, wherein the threshold condition is one or more of a duration of time associated with an inactivity condition or a zero credit balance condition.

6. The electronic gaming machine according to claim 1, wherein the first total game payout rate is calculated based upon a base game payout rate and a bonus game payout rate.

7. The electronic gaming machine according to claim 1, wherein the gaming machine controller is configured to compute the second total game payout rate using a lookup table comprising a plurality of player credit input thresholds.

8. The electronic gaming machine according to claim 1, wherein the gaming machine controller is further configured to adjust a frequency at which a bonus game is presented based upon a comparison of the first total game payout rate to the second total game payout rate.

9. The electronic gaming machine according to claim 1, wherein the recorded player credit inputs include a player credit input for a current round of play.

10. An electronic gaming machine server configured to be in electronic communication with a plurality of electronic gaming devices for conducting an electronic game, the electronic gaming machine server comprising:

a memory storing at least a first overall game return-to-player (RTP) as a current RTP and a second overall game RTP as an inactive RTP; and a processor configured to:

send a communication to at least one of the electronic gaming devices, the communication instructing the at least one gaming device to conduct the electronic game at the first overall game RTP;

adjust the current RTP to be the second overall game RTP based on a predetermined condition being satisfied; and send a communication to at least one of the electronic gaming devices to conduct the electronic game at the second overall game RTP after the condition has been satisfied.

11. The electronic gaming machine server according to claim 10, wherein the memory is configured to store at least a portion of game software for conducting the electronic game, and wherein the processor is further configured to send a communication to the at least one gaming device that includes the portion of the game software.

12. The electronic gaming machine according to claim 11, wherein the remote gaming server further comprises a communication device for transmitting and receiving communications through a casino network and the plurality of electronic gaming devices are remote gaming devices in electronic communication with the casino network.

13. The electronic gaming machine according to claim 12, wherein the memory is configured to store wager data received from the at least one gaming device, calculate a moving average of the stored wager data and wherein the predetermined condition is based on the calculated moving average.

14. A method of electronic gaming implemented on an electronic gaming machine, the method comprising:

receiving, by a game controller of the electronic gaming machine, respective credit data for a plurality of rounds of play of an electronic game;

conducting, by the game controller, each of the plurality of rounds of play upon receipt of the respective credits to generate gaming data, the gaming data including a first overall game return-to-player (RTP) used during the plurality of rounds of play, the plurality of rounds of play being prior to a current round of play;

determining a plurality of credit amounts, by the game controller, for the plurality of rounds according to the first overall game RTP;

computing a second overall game RTP different than the first overall game RTP based on the gaming data from the plurality of rounds of play;

configuring the electronic gaming machine with the second RTP;

conducting, by the game controller, a next round of play of the electronic game; and determining, by the game controller, a second credit amount for the next round of play according to the second overall game RTP.

15. The method according to claim 14, further comprising computing a moving average of the credit data for the plurality of rounds of play.

16. The method according to claim 15, further comprising computing the second RTP rate using the moving average of the credit data.

17. The method according to claim 14, further comprising resetting the first overall game RTP or the second overall game RTP after a threshold condition has been satisfied.

18. The method according to claim 17, wherein the threshold condition is one or more of a duration of time associated with an inactivity condition or a zero credit balance condition.

19. The method according to claim 14, wherein computing the second overall game RTP includes querying a lookup table comprising a plurality of credit input thresholds.

20. The method according to claim 14, further comprising adjusting a frequency at which a bonus game is presented based upon a comparison of the first overall game RTP to the second overall game RTP.

* * * * *